US010405111B2

(12) United States Patent
Van Der Werf

(10) Patent No.: US 10,405,111 B2
(45) Date of Patent: Sep. 3, 2019

(54) ACTIVE OCCLUSION CANCELLATION

(71) Applicant: GN HEARING A/S, Ballerup (DK)

(72) Inventor: Erik Cornelis Diederik Van Der Werf, Eindhoven (NL)

(73) Assignee: GN HEARING A/S, Ballerup (DK)

( * ) Notice: Subject to any disclaimer, the term of this patent is extended or adjusted under 35 U.S.C. 154(b) by 8 days.

(21) Appl. No.: 15/668,115

(22) Filed: Aug. 3, 2017

(65) Prior Publication Data

US 2018/0184219 A1 Jun. 28, 2018

(30) Foreign Application Priority Data

Dec. 22, 2016 (EP) ..... 16206073

(51) Int. Cl.
*H04R 25/00* (2006.01)

(52) U.S. Cl.
CPC ..... *H04R 25/652* (2013.01); *H04R 25/407* (2013.01); *H04R 25/453* (2013.01); *H04R 25/505* (2013.01); *H04R 2460/05* (2013.01)

(58) Field of Classification Search
CPC combination set(s) only.
See application file for complete search history.

(56) References Cited

U.S. PATENT DOCUMENTS 7,599,507 B2 * 10/2009 Hansen ..... G10L 21/0208 381/312
2007/0217639 A1 * 9/2007 Stirnemann ..... H04R 25/70 381/321

FOREIGN PATENT DOCUMENTS

WO WO 2004/021740 A1 3/2004
WO WO 2008/043793 A1 4/2008
WO WO 2014/075195 A1 5/2014
WO WO 2014075195 * 5/2014

OTHER PUBLICATIONS

Extended European Search Report dated Jun. 30, 2017 for corresponding EP Patent Application No. 16206073.5, 7 pages.

* cited by examiner

*Primary Examiner* — Amir H Etesam

(74) *Attorney, Agent, or Firm* — Vista IP Law Group, LLP

(57) ABSTRACT

A hearing device includes: a microphone for providing an audio signal; a signal processor for generating a processed audio signal; a first subtractor having a first input for receiving the processed audio signal, a second input, and an output for providing a first combined audio signal; a receiver for converting the first combined audio signal into an output sound signal; an ear canal microphone configured to provide an ear canal audio signal; a second subtractor having a first input for receiving the ear canal audio signal, a second input, and an output for providing a second combined audio signal; a first filter for receiving the second combined audio signal and for providing a filtered second combined audio signal to the second input of the first subtractor; and a second filter for providing a filtered processed audio signal to the second input of the second subtractor.

21 Claims, 11 Drawing Sheets

ACTIVE OCCLUSION CANCELLATION

RELATED APPLICATION DATA

This application claims priority to, and the benefit of, European Patent Application No. 16206073.5 filed on Dec. 22, 2016. The entire disclosure of the above application is expressly incorporated by reference herein.

FIELD

An embodiment described herein relates to a hearing device.

BACKGROUND

The occlusion effect is the unnatural perception of a users own voice caused by inserting a mould or a shell into the ear canal. Depending on individual geometry, the occlusion effect may cause low frequency amplification up to 30 dB. For open fits occlusion is not a problem. However, there may be situations where open fits are not feasible, e.g., due to gain or output power limitations, or when the ear canal must be sealed for protective purposes. When conventional solutions (larger vents, deep fitting, etc.) fail, Active Occlusion Cancellation (AOC) may be a viable alternative. AOC attempts to reduce the occlusion effect adding a signal in opposite phase that suppresses or cancels undesired (low) frequencies in the ear canal of the user.

SUMMARY

A new hearing device is provided, comprising a microphone for provision of an audio signal in response to ambient sound received at the microphone, a signal processor that is adapted to process the audio signal in accordance with a predetermined signal processing algorithm to generate a processed audio signal, a first subtractor having a first input that is connected for reception of the processed audio signal and a second input and an output for provision of a first combined audio signal that is equal to the signal received at the first input minus the signal received at the second input of the first subtractor, a receiver connected for reception of the first combined signal for converting the combined audio signal into an output sound signal for emission towards an eardrum of a user, a housing that is adapted to be positioned in an ear canal of a user of the hearing device and accommodating an ear canal microphone that is positioned in the housing for provision of an ear canal audio signal in response to an ear canal sound pressure, when the housing is positioned in its intended operating position in the ear canal, a second subtractor having a first input that is connected for reception of the ear canal audio signal and a second input and an output for provision of a second combined audio signal that is equal to the difference between the signal received at the first input and the signal received at the second input of the second subtractor, a first filter having an input that is connected for reception of the second combined audio signal for provision of a filtered second combined audio signal to the second input of the first subtractor, and a second filter having an input that is connected for reception of the processed audio signal generated by the signal processor and an output for provision of a filtered processed audio signal to the second input of the second subtractor.

Throughout the present disclosure, the "audio signal" provided by the microphone may be used to identify any analogue or digital signal forming part of the signal path from the output of the microphone to the first input of first subtractor, including processed output signals of the microphone and including sequences of individual samples of the audio signal and blocks of samples of the audio signal.

Likewise, the "ear canal audio signal" provided by the ear canal microphone may be used to identify any analogue or digital signal forming part of the signal path from the output of the ear canal microphone to the first input of second subtractor, including processed output signals of the ear canal microphone and including sequences of individual samples of the ear canal audio signal and blocks of samples of the ear canal audio signal.

The hearing device comprises an active occlusion cancellation circuit comprising the first and second filters and the first and second subtractors and the ear canal microphone.

The first filter has a transfer function B and provides the occlusion cancellation signal so that the user desirably perceives only the processed audio signal, without a perceived body conducted sound.

The first filter may be a recursive filter, a FIR filter, a multi-rate FIR filter, etc.

The first filter may be adapted to perform filtering sequentially, sample by sample, to minimize delay.

The second filter has a transfer function A and models the transfer function R of the signal path from the input of the receiver to the output of the ear canal microphone to distinguish the desired signal, namely the processed audio signal, from the undesired signal picked up by the ear canal microphone together with the desired signal. In this way, the subtraction performed by the second subtractor of the output signal of the second filter from the ear canal audio signal suppresses and ideally cancels the receiver's influence on the performance of the occlusion cancellation provided by the ear canal microphone and the first filter.

The second filter may be an adaptive filter to track changes in the transfer function of the signal path from the input of the receiver to the output of the ear canal microphone.

The second filter output may be calculated for blocks of samples, e.g. the second filter may be included in the signal processor as part of the signal processing performed on blocks of samples.

The signal processor may be adapted to perform signal processing in blocks of samples for processing efficiency, e.g. low power consumption, low number of MIPS, etc.

Each of the first and second subtractors may be adapted to perform subtraction sequentially, sample by sample to minimize delay.

The hearing device may comprise a third subtractor inserted between the first subtractor and the receiver and having a first input that is connected for reception of the first combined audio signal and a second input and an output for provision of a third combined audio signal that is equal to the signal received at the first input minus the signal received at the second input of the third subtractor, a fourth subtractor having a first input that is connected for reception of the ear canal audio signal and a second input and an output for provision of a fourth combined audio signal that is equal to the difference between the signal received at the first input and the signal received at the second input of the fourth subtractor, a third filter having a transfer function $B_2$ and an input that is connected for reception of the fourth combined audio signal for provision of a filtered fourth combined audio signal to the second input of the third subtractor, and a fourth filter having a transfer function $A_2$ and an input that is connected for reception of the third combined audio signal and an output for provision of a third combined audio signal to the second input of the fourth subtractor.

The hearing device may comprise a third subtractor inserted between the first subtractor and the signal processor and having a first input that is connected for reception of the processed audio signal and a second input and an output for provision of a third combined audio signal to the input of the second filter and to the first input of the first subtractor, wherein the third combined audio signal is equal to the signal received at the first input minus the signal received at the second input of the third subtractor, and a third filter having an input that is connected for reception of the second combined audio signal and an output for provision of a filtered second combined output signal to the second input of the third subtractor.

Each of the first and second and third and fourth filters may be multi-rate filters. A multi-rate design is utilized to obtain low delay that improves active occlusion cancellation.

In the multi-rate filter, the leading taps may operate at full rate followed by down-sampling, e.g. by 8, to reduce complexity.

Low pass filters may be provided between the leading taps of the multi-rat filter. The low pass filters may be moving average filters having low fixed point complexity and have uniform delay between filter taps just as in ordinary FIR filters.

The group delay between taps of the multi-rate filter is constant as a function of frequency just as for ordinary FIR filters.

The magnitude responses of leading filter taps of the multi-rate filter, i.e. the taps before down-sampling, are different for high frequencies. Additional filters, e.g. filters with fixed filter coefficients, may be provided to safeguard the leading taps. The additional filters may suppress the high frequencies, so that ordinary FIR behaviour of the multi-rate filter can be approximated to an arbitrary degree, possibly at the expense of some increase in group delay.

A scalar gain g may be provided in the active occlusion cancellation circuit, e.g. at the output of the first filter. The scalar gain g may be used to quickly adapt the loop gain in case of potential instability or overload, e.g. the scalar gain g may be connected for adjustment of the magnitude of the filtered second combined audio signal provided to the second input of the first subtractor.

Each of the first, second, third and fourth filters may be initialized, i.e. the filter coefficients of the respective filter may be determined, during a fitting session during which the hearing device is fitted to the intended user of the hearing device.

During the fitting session, a known signal may be injected into the open circuited active occlusion cancellation circuit and data collection may be performed with an external device connected to the hearing device, e.g. a Personal Computer (PC), for determination of filter coefficients.

For example, the output of the first subtractor may be disconnected from the input of the receiver for open-loop determination of the transfer function R of the signal path from the input of the receiver to the output of the ear canal microphone.

A probe signal, e.g. a maximum length sequence (MLS) signal, may be transmitted to the receiver and based on the ear canal microphone output signal that includes a response to the probe signal; the impulse response of the signal path may be estimated. As mentioned above, the second filter is intended to model the transfer function R of the signal path, and thus, the filter coefficients of the second filter may be determined from the transfer function R.

The ear canal microphone output signal may be transmitted to the external device that performs cross-correlation of the probe signal with the received ear canal microphone output signal to determine the impulse response of the signal path. Then the external device may determine the filter coefficients of the second filter and transfer them to the second filter of the hearing device so that the second filter also has the determined impulse response and so that subsequent to initialization, the second filter models the transfer function R of the signal path.

Subsequent to determination of the filter coefficients of the second filter, the external, device may operate to optimize the transfer function B of the first filter to obtain the desired cancellation of the occlusion effect, preferably within a set of constraints, e.g. including stability of the hearing device circuit, upper limits for peaking and gain, etc.

Peaking refers to the effect that the users own voice may be amplified at frequencies outside the cancellation range. An upper limit for peaking imposes a limitation on the amount of amplification that the user's own voice may be subjected to at frequencies outside the cancellation range.

Some of the constraints may be user adjustable.

The external device may optimize the transfer function B of the first filter heuristically by an iterative constrained least squares procedure, e.g. including iterative frequency weighting. This is explained in more detail below with reference to the figures.

During recursive iteration, every iteration step may include a full least squares optimization determining the global minimum of $|E|^2$ of an error equation that may be followed by a step of heuristic update of parameters of the error equation, wherein one or more parameters may adapt to satisfy constraints, and one or more other parameters may adapt to approach a desired amount of occlusion cancellation.

Each of the first, second, third, and fourth filters may be adaptive filters that adapt during normal operation of the hearing device.

In this way, performance degradation over time, e.g. due to slow changes, such as wax build-up, component drift, etc., or due to faster changes, e.g. caused by re-insertion differences, is avoided. Further, the user's occluded voice spectrum may be taken into account.

The filter coefficients of the adaptive filters may be adapted to obtain a solution or an approximate solution of an error equation, e.g. to minimize a difference between two signals or functions, and the algorithm controlling the adaption of the adaptive filters may be, without being restricted to, a least mean square (LMS) algorithm, a normalized least mean square (NLMS) algorithm, a recursive least squares (RLS) algorithm, a normalized recursive least squares (NRLS) algorithm, etc.

Various weights may be incorporated into the adaption so that the solution or minimization is optimized in accordance with values of the weights. For example, frequency weights $w_f$ may optimize the solution or minimization in certain one or more frequency ranges while information in other frequency ranges may be disregarded.

For example, the second filter with transfer function A may adapt during normal operation of the hearing device so that the transfer function A of the second filter is adapted toward and tracks changes in the transfer function R of the signal path from the input of the receiver to the output of the ear canal microphone. Thus, the second filter may have filter coefficients that are adapted so that the difference between the ear canal audio signal and the output of the second filter is minimized.

The first filter may adapt so that the transfer function B is optimized for provision of a desired output signal of the first filter for occlusion cancellation at desired frequencies without causing undesired side effects, such as excessive amplification or instability, i.e. under certain constraints as explained in more detail below.

Each of the adaptive filters may be initialized, i.e. the filter coefficients of the adaptive filters may be determined during a fitting session and possibly whenever the user turns the hearing device on.

Although in principle, an adaptive filter automatically adapts to changes of whatever the adaptive filter is intended to model, as e.g. the signal path modelled by the second filter, there may be limitations to the extent and accuracy that the adaptive filter can track such changes. Initialization of the adaptive filter may lead to fast and accurate modelling and effective active occlusion cancellation during subsequent operation by provision of a starting point for the adaptation that is close to the desired end result.

The adaptive filters may be initialized using an external device, such as a PC, in the same was as described above for fixed filters, e.g. utilizing a probe signal and perform open-loop determinations.

The adaptive filters may be operated without initialization whereby time is saved during a possible fitting session and possible user annoyance due to sound emitted during the determinations of e.g. transfer functions, is avoided. Also, initialization is impractical for over-the counter sales.

The accuracy of the resulting transfer function of the adaptive filter is dependent on statistical properties of the signals included in the error equation. For example, in an ideal situation, the user is quiet and the signal emitted by the receiver contains white noise. When this is not the case, e.g., when the user is talking, the accuracy may be reduced and results may be biased due to correlations between signals. A simple way to overcome such problems may be lower the rate of adaptation, or temporarily disable adaptation when the speech signal from the user is large. Alternatively some form of filtered cross-correlations known for feedback cancellation systems of hearing aids or other forms of decorrelation could be used.

The first filter may adapt based on the transfer function A of the second filter as the best available estimate of the transfer function R. For adequate low frequency behaviour, a good insertion fit in the ear canal is important. A poorly inserted housing typically causes a small magnitude response for transfer function A at low frequencies because sound pressure is lowered due to passages between the housing and the ear canal wall. This would require the transfer function B to become very large, potentially causing overload and instability problems. Therefore when the magnitude response of the first filter is below some threshold, the loop gain may be turned down to zero and the adaption of the second filter may be stopped, or the second filter coefficients may be leaked back to zero. Otherwise, the transfer function B of the second filter may be adapted to optimize the loop response using a set of constraints and targets, where the targets specify the desired amount of cancellation at desired frequencies, and the constraints limit undesired side effects. Constraints are defined for the following aspects:

1. Stability is guaranteed when the complex valued digital frequency response of the denominator (Nyquist contour) does not encircle the origin. In principle, determining Nyquist stability may require a procedure for counting encirclements of the origin (clockwise minus counter-clockwise), which is a bit involved. However, the criterion can be simplified by setting a positive lower limit for the real parts of the complex values because if the contour only uses positive real values it simply cannot encircle the origin.

2. Max peaking sets an upper limit for the expected closed loop gain.

3. Max loop gain sets an upper limit for the expected open loop gain.

4. Max B gain sets an upper limit for the gain |B| of the second filter.

When all constraints are fulfilled, the adaptation algorithm determines cancellation performance, i.e. constraints are always satisfied first. It should be noted that normally all constraints can be met simply by lowering the loop gain, which may be performed during normal use of the hearing device using a scalar gain control so that for reasonable settings there is always a solution that satisfies all constraints.

For optimizing the response at cancellation frequencies, large positive real values of the Nyquist contour are generally desirable since they provide cancellation and reduce the risk of instability. Large absolute imaginary values may also be useful, but require a choice between positive and negative direction which may be non-trivial and could increase the risk of getting trapped in a local optimum. In the current implementation, for reaching the cancellation target, the update therefore only uses a real-valued gradient direction. Adding an imaginary part, possibly introduced at a stage where the real valued update has converged, may lead to further improvements.

The adaptation algorithm of the first filter with transfer function B may utilize the Discrete Fourier Transform (DFT), which can be realized efficiently (O(nlog(n)) using a Fast Fourier Transform (FFT). For a sequence $x_1$, $x_1$, $x_2$, . . . , $x_{N-1}$ the DFT for frequency bin $X_k$ is given by $$X_k = \sum_{n=0}^{N-1} x_n e^{-2\pi ikn/N}$$

where N is the total number of frequency bins (when N exceeds the sequence length of x, e.g., for a short filter, the missing values can be assumed zero). The Fourier transform is a linear mapping. By representing sequences x and X as vectors the DFT can be written as $$\vec{X} = M\vec{x}$$

where M is a complex valued orthogonal symmetrical matrix, called the Fourier matrix, which performs the mapping from the time domain to the frequency domain. The inverse mapping, back to the time domain, can be done using the same matrix scaled by a factor 1/N.

The signal processor is adapted for processing of sound received by the hearing device in a way that is suitable for the intended use of the hearing device. As is well known in the art, the processing of the signal processor is controlled by a signal processing algorithm having various parameters for adjustment of the actual signal processing performed.

The gains in each of the frequency channels of a multi-channel hearing aid are examples of such parameters.

The hearing device may be a headset, headphone, earphone, ear defender, or earmuff, etc., such as an Ear-Hook, In-Ear, On-Ear, Over-the-Ear, Behind-the-Neck, Helmet, or Headguard, etc.

The hearing device may be a hearing aid, such as a Behind-The-Ear (BTE), Receiver-In-the-Ear (RIE), In-The-Ear (ITE), In-The-Canal (ITC), or Completely-In-the-Canal (CIC), etc., hearing aid.

In the hearing aid, the signal processor comprises a hearing loss processor that is adapted to process the audio signal in accordance with a predetermined signal processing algorithm to generate a hearing loss compensated audio signal for compensation of the user's hearing loss. The hearing loss processor may comprise a dynamic range compressor adapted for compensating the hearing loss of the user, including loss of dynamic range as a function of frequency.

The flexibility of the signal processor may be utilized to provide a plurality of different algorithms and/or a plurality of sets of parameters of a specific algorithm. For example, various algorithms may be provided for noise suppression, i.e. attenuation of undesired signals and amplification of desired signals. Desired signals are usually speech or music, and undesired signals can be background speech, restaurant clatter, music (when speech is the desired signal), traffic noise, etc.

Consequently, the signal processor may be provided with a number of different programs, each program tailored to a particular sound environment or sound environment category and/or particular user preferences.

In a hearing aid, signal processing characteristics of each of these programs is typically determined during an initial fitting session in a dispenser's office and programmed into the hearing aid by activating corresponding algorithms and algorithm parameters in a non-volatile memory area of the hearing aid and/or transmitting corresponding algorithms and algorithm parameters to the non-volatile memory area.

The signal processor may be adapted for dividing the audio signal into a plurality of frequency bands, e.g. utilizing a filter bank, e.g. a filter bank with linear phase filters.

The frequency bands may be warped frequency bands, e.g. utilizing a filter bank with warped filters. The warped frequency bands may correspond to the Bark frequency scale of the human ear.

The signal processor may be adapted for dividing the audio signal into the plurality of frequency bands by subjecting the audio signal to a frequency transformation, such as a Fourier Transformation, such as a Discrete Fourier Transformation, a Fast Fourier Transformation, etc., or a Warped Fourier Transformation, a Warped Discrete Fourier Transformation, a Warped Fast Fourier Transformation, etc.

Signal processing in the hearing device system may be performed by dedicated hardware or may be performed in one or more signal processors, or performed in a combination of dedicated hardware and one or more signal processors.

As used herein, the terms "processor", "central processor", "hearing loss processor", "signal processor", "controller", "system", etc., are intended to refer to CPU-related entities, either hardware, a combination of hardware and software, software, or software in execution.

For example, a "processor", "signal processor", "controller", "system", etc., may be, but is not limited to being, a process running on a processor, a processor, an object, an executable file, a thread of execution, and/or a program.

By way of illustration, the terms "processor", "central processor", "hearing loss processor", "signal processor", "controller", "system", etc., designate both an application running on a processor and a hardware processor. One or more "processors", "central processors", "hearing loss processors", "signal processors", "controllers", "systems" and the like, or any combination hereof, may reside within a process and/or thread of execution, and one or more "processors", "central processors", "hearing loss processors", "signal processors", "controllers", "systems", etc., or any combination hereof, may be localized in one hardware processor, possibly in combination with other hardware circuitry, and/or distributed between two or more hardware processors, possibly in combination with other hardware circuitry.

Also, a signal processor (or similar terms) may be any component or any combination of components that is capable of performing signal processing. For examples, the signal processor may be an ASIC processor, a FPGA processor, a general purpose processor, a microprocessor, a circuit component, or an integrated circuit.

A hearing device includes: a microphone for provision of an audio signal in response to ambient sound received at the microphone; a signal processor that is adapted to process the audio signal in accordance with a predetermined signal processing algorithm to generate a processed audio signal; a first subtractor having a first input that is connected for reception of the processed audio signal and a second input and an output for provision of a first combined audio signal that is equal to the signal received at the first input minus the signal received at the second input of the first subtractor; a receiver connected for reception of the first combined audio signal for converting the combined audio signal into an output sound signal for emission towards an eardrum of a user; a housing that is adapted to be positioned in an ear canal of a user of the hearing device and accommodating an ear canal microphone that is positioned in the housing for provision of an ear canal audio signal in response to an ear canal sound pressure, when the housing is positioned in its intended operating position in the ear canal; a second subtractor having a first input that is connected for reception of the ear canal audio signal and a second input and an output for provision of a second combined audio signal that is equal to the difference between the signal received at the first input and the signal received at the second input of the second subtractor; a first filter having an input that is connected for reception of the second combined audio signal for provision of a filtered second combined audio signal to the second input of the first subtractor; and a second filter having an input that is connected for reception of the processed audio signal generated by the signal processor and an output for provision of a filtered processed audio signal to the second input of the second subtractor.

Optionally, the signal processor is adapted for operation in blocks of samples and the first filter is adapted to perform filtering sequentially sample by sample.

Optionally, the second filter is adapted to perform filtering in blocks of samples.

Optionally, the second filter is included in the signal processor.

Optionally, the hearing device further includes a third subtractor inserted between the first subtractor and the receiver and having a first input that is connected for reception of the first combined audio signal and a second input and an output for provision of a third combined audio signal that is equal to the signal received at the first input minus the signal received at the second input of the third subtractor; a fourth subtractor having a first input that is connected for reception of the ear canal audio signal and a second input and an output for provision of a fourth combined audio signal that is equal to the difference between the signal received at the first input and the signal received at the second input of the fourth subtractor; a third filter having a transfer function $B_2$ and an input that is connected for reception of the fourth combined audio signal for provision of a filtered fourth combined audio signal to the second input of the third subtractor; and a fourth filter having a transfer function $A_2$ and an input that is connected for reception of the third combined audio signal and an output for provision of a third combined audio signal to the second input of the fourth subtractor.

Optionally, the hearing device further includes: a third subtractor inserted between the first subtractor and the signal processor and having a first input that is connected for reception of the processed audio signal and a second input and an output for provision of a third combined audio signal to the input of the second filter and to the first input of the first subtractor, wherein the third combined audio signal is equal to the signal received at the first input minus the signal received at the second input of the third subtractor; and a third filter having an input that is connected for reception of the second combined audio signal and an output for provision for a filtered second combined output signal to the second input of the third subtractor.

Optionally, at least one of the first filter and the second filter is a multi-rate filter.

Optionally, the hearing device further includes a scalar gain unit for adjustment of the magnitude of the filtered second combined audio signal provided to the second input of the first subtractor.

Optionally, the hearing device further includes a signal generator for provision of a probe signal to the receiver and a connector for connection of the hearing device to an external device for data collection of signals generated in the hearing device in response to the probe signal and for transmission of signal processing parameters to the hearing device calculated by the external device based on the collected signals.

Optionally, at least one of the first ter and the second filter is an adaptive filter.

Optionally, at least one of the first filter and the second filter adapts during normal use of the hearing device.

Optionally, the second filter has filter coefficients which are adapted so that the difference between the ear canal audio signal and the output of the second filter is minimized.

Optionally, the first filter has filter coefficients which are adapted towards a selected target transfer functions subjected to selected constraints.

A hearing device includes: a microphone for providing an audio signal in response to ambient sound received at the microphone; a signal processor configured to process the audio signal in accordance with a signal processing algorithm to generate a processed audio signal; a first subtractor having a first input configured for reception of the processed audio signal, a second input, and an output for providing a first combined audio signal; a receiver configured to receive the first combined audio signal, and to convert the first combined audio signal into an output sound signal for emission towards an eardrum of a user of the hearing device; a housing configured to be positioned in an ear canal of the user, the housing accommodating an ear canal microphone that is configured to provide an ear canal audio signal in response to an ear canal sound pressure, when the housing is positioned in the ear canal; a second subtractor having a first input configured for reception of the ear canal audio signal, a second input, and an output for providing a second combined audio signal; a first filter configured to receive the second combined audio signal, and to provide a filtered second combined audio signal to the second input of the first subtractor; and a second filter configured to receive the processed audio signal generated by the signal processor, and to provide a filtered processed audio signal to the second input of the second subtractor.

Optionally, the signal processor is configured for operation in blocks of samples, and wherein the first filter is configured to perform filtering sample by sample.

Optionally, the second filter is configured to perform filtering in blocks of samples.

Optionally, the second filter is included in the signal processor.

Optionally, the hearing device further includes: a third subtractor coupled between the first subtractor and the receiver, the third subtractor having a first input that configured for reception of the first combined audio signal, a second input, and an output for providing a third combined audio signal; and a fourth subtractor having a first input that is configured for reception of the ear canal audio signal, a second input, and an output for providing a fourth combined audio signal.

Optionally, the hearing device further includes a third filter having a transfer function $B_2$, the third filter configured to receive the fourth combined audio signal, and to provide a filtered fourth combined audio signal to the second input of the third subtractor.

Optionally, the hearing device further includes a fourth filter having a transfer function $A_2$, the fourth filter configured to receive the third combined audio signal, and to provide a filtered third combined audio signal to the second input of the fourth subtractor.

Optionally, the hearing device further includes a third subtractor coupled between the first subtractor and the signal processor, the third subtractor having a first input configured for reception of the processed audio signal, a second input, and an output coupled to the input of the second filter and to the first input of the first subtractor.

Optionally, the hearing device further includes a third filter having an input configured for reception of the second combined audio signal, and an output coupled to the second input of the third subtractor.

Optionally, at least one of the first filter and the second filter is a multi-rate filter.

Optionally, the hearing device further includes a scalar gain unit configured to adjust a magnitude of the filtered second combined audio signal provided to the second input of the first subtractor.

Optionally, the hearing device further includes a signal generator configured for providing a probe signal to the receiver.

Optionally, the hearing device further includes a connector for connection of the hearing device to an external device for collection of signals generated in the hearing device in response to the probe signal, wherein the connector is also configured for transmission of signal processing parameters to the hearing device from the external device, the signal processing parameters being based on the collected signals.

Optionally, one or each of the first filter and the second filter is an adaptive filter.

Optionally, one or each of the first filter and the second filter is configured to perform adaptation during normal use of the hearing device.

Optionally, the second filter has filter coefficients that are variable to reduce a difference between the ear canal audio signal and the output of the second filter.

Optionally, the first filter has filter coefficients that are adapted towards a target transfer function.

Optionally, the first combined audio signal is equal to the processed audio signal received at the first input of the first subtractor, minus the filtered second combined audio signal received at the second input of the first subtractor Optionally, the second combined audio signal is equal to a difference between the ear canal audio signal received at the first input of the second subtractor, and the filtered processed audio signal received at the second input of the second subtractor.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict exemplary embodiments and are not therefore to be considered limiting of its scope.

In the drawings.

DETAILED DESCRIPTION

Various illustrative examples of the new hearing device according to the appended claims will now be described more fully hereinafter with reference to the accompanying drawings, in which various embodiments of new hearing device are illustrated. The new hearing device according to the appended claims may, however, be embodied in different forms and should not be construed as limited to the embodiments set forth herein. In addition, an illustrated embodiment needs not have all the aspects or advantages shown. An aspect or an advantage described in conjunction with a particular embodiment is not necessarily limited to that embodiment and can be practiced in any other examples even if not so illustrated, or if not so explicitly described.

As used herein, the singular forms "a," "an," and "the" refer to one or more than one, unless the context clearly dictates otherwise.

Figure 1:
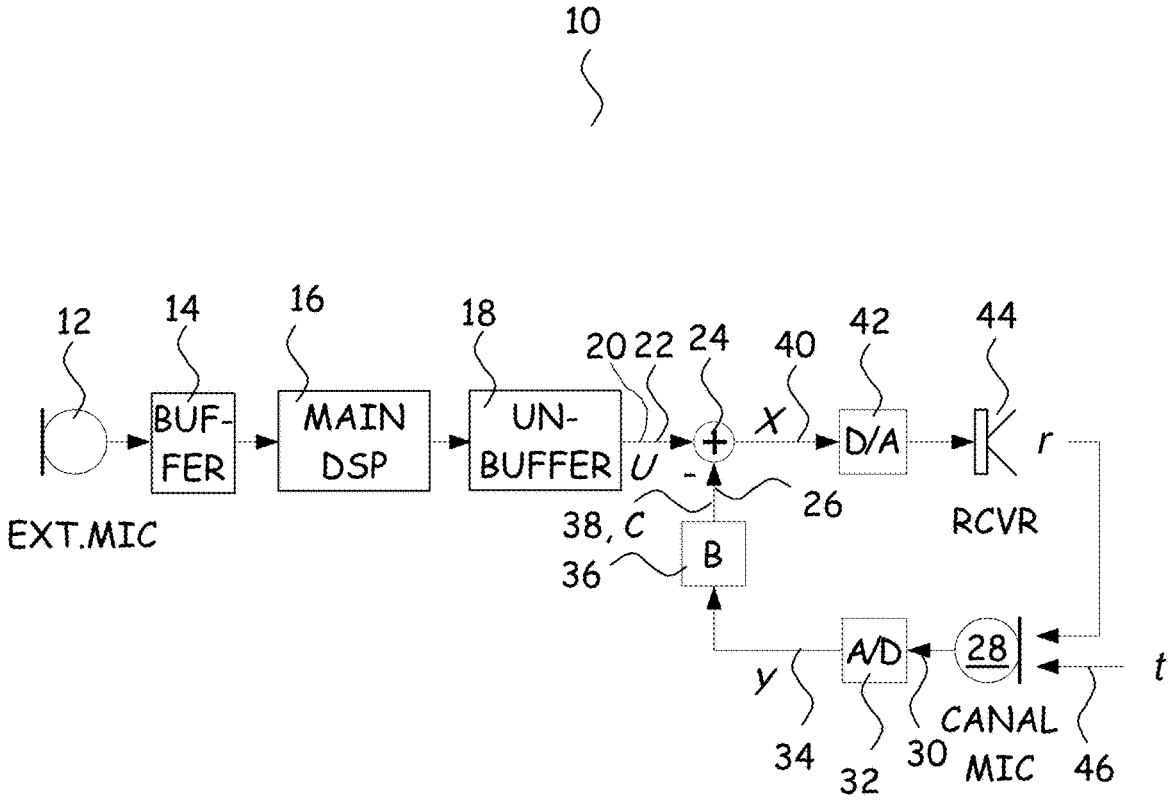
(Prior art) Fig. 1
FIG. 1 shows a block diagram of a known active occlusion suppression circuit.

FIG. 1 shows a block diagram of a known hearing device circuitry 10 with active occlusion suppression circuit.

The hearing device has a microphone 12 for provision of an audio signal in response to ambient sound received at the microphone 12. The audio signal is sampled and digitized in an A/D converter (not shown) and the buffer 14 groups the samples into blocks of samples for input to the signal processor 16.

The signal processor 16 is adapted to process the sample blocks in accordance with a predetermined signal processing algorithm to generate processed blocks of samples, each of which is divided into a sequence of single samples in the unbuffer circuit 18 forming the processed audio signal 20.

The processed audio signal 20 is input to a first input 22 of a subtractor 24. A signal input at a second input 26 of the subtractor 24 is subtracted from the processed audio signal 20 to reduce the occlusion effect by subtracting a signal that cancels undesired low frequency sound in the user's ear canal generated by low frequency amplification of the user's own voice. The user's own voice is picked up by an ear canal microphone 28 that is accommodated in a housing (not shown) that is adapted to be positioned in an ear canal of the user whereby the ear canal microphone 28 is positioned to sense the ear canal sound pressure inside the fully or partly occluded ear canal space between a distal portion of the housing (not shown) and the ear drum (not shown). The ear canal sound pressure detected by the ear canal microphone 28 is a superposition of body conducted sound and receiver emitted sound. The ear canal microphone 28 is adapted for provision of an ear canal audio signal 30 in response to the ear canal sound pressure. The ear canal audio signal 30 is sampled and digitized in an A/D converter 32 and the samples 34 are forwarded sequentially to the filter 36 that inputs a filtered ear canal audio signal 38 suitable for suppression of the occlusion effect at the second input 26 of the subtractor 24, whereby the user perceives only the processed audio signal, without a perceived body conducted sound.

The subtractor 24 provides a combined audio signal 40 that is equal to the signal 20 received at the first input 22 minus the signal 38 received at the second input 26 of the subtractor 24 to a D/A converter 42 for conversion of the digital combined audio signal into an analogue signal that is converted in a receiver 44 to an acoustic signal for emission towards the eardrum of the user.

When x is the combined audio signal 40, u is the processed audio signal 20, t is the target signal 46 that is desirably cancelled, y is the ear canal audio signal 34, B is the transfer function of the filter 36, R is the transfer function from the input of the receiver 44 to the output of the ear canal microphone 28 (y/x); then, slightly simplified, the combined audio signal x is given by:

$$x = \frac{u - Bt}{1 + BR} \tag{1}$$

and the ear canal audio signal y is given by:

$$y = \frac{Ru + t}{1 + BR} \tag{2}$$

wherein the transfer function from the receiver 44 to the output of the ear canal microphone 28 has been simplified to $$y = Rx + t$$

ignoring possible non-linarites and attributing all signal delays to the receiver 44.

In the known active occlusion cancellation circuit 24, 28, 32, 36 shown in FIG. 1, it is not possible to distinguish between desired and undesired signals. As a consequence the main signal path of the circuit of FIG. 1 from the processed audio signal 20 to the output of the receiver 44 requires additional amplification to obtain the same output signal as without the active occlusion cancellation circuit, i.e. the processed audio signal 20 has to be multiplied with [1+BR] to compensate for the active occlusion cancellation circuit. This may lead to reduced dynamic range, e.g., by saturation at the receiver for lower magnitudes of the compensated audio signal 20 and/or an increase in the noise floor.

Figure 2:
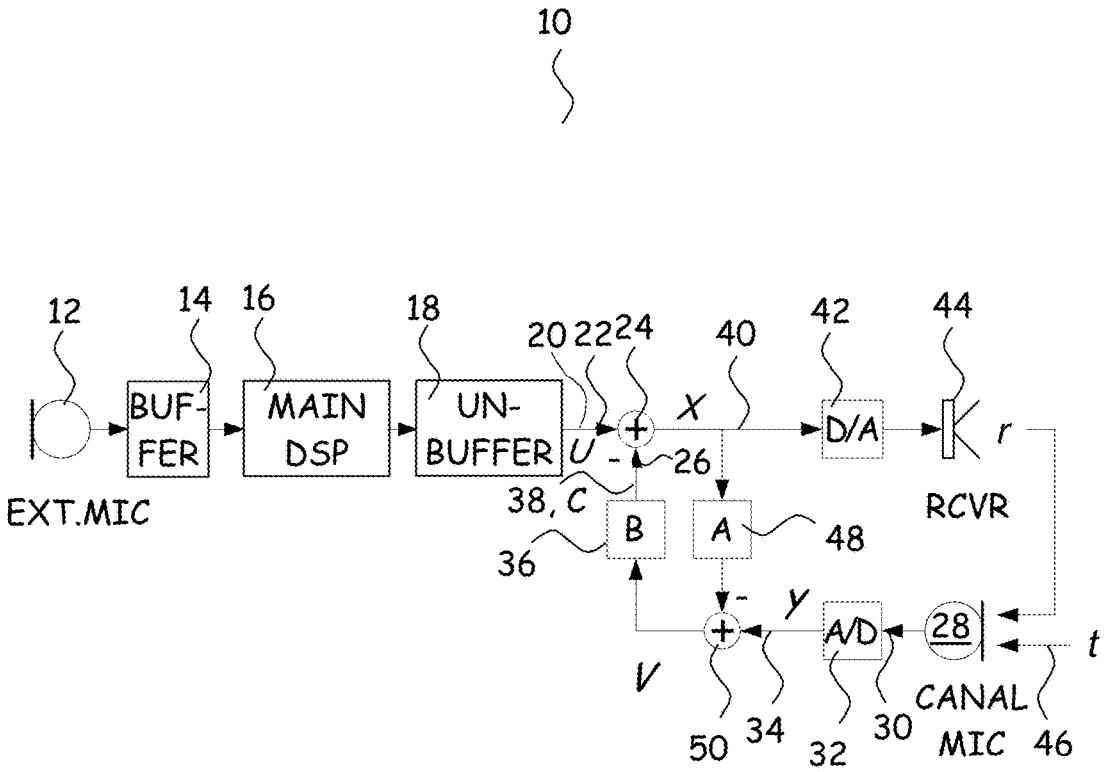
(Prior art) Fig. 2
FIG. 2 shows a block diagram of another known active occlusion suppression circuit.

FIG. 2 shows a block diagram of a hearing device circuitry 10 with another active occlusion suppression circuit. The circuitry 10 of FIG. 2 is identical to the circuitry 10 of FIG. 1 apart from the fact that in the circuitry of FIG. 2 a second filter 48 and a second subtractor 50 have been added to the circuitry 10 of FIG. 1. In FIG. 2, the first filter 36 and the first subtractor 24 correspond to the filter 36 and the subtractor 24, respectively, of FIG. 1.

The second filter 48 models the transfer function of the signal path from the input of the receiver 44 to the output of the ear canal microphone 28 (y/x) to distinguish the desired signal, namely the processed audio signal 20, from the undesired signal, namely the target signal 46. Like the first filter 36, the second filter 48 operates sample based with very low delay.

In the active occlusion cancellation circuit of FIG. 2, the equations (1) and (2) of the active occlusion cancellation circuit of FIG. 1 turn into:

$$x = \frac{u - Bt}{1 + B(R - A)} \tag{3}$$

$$y = \frac{Ru + (1 - AB)t}{1 + B(R - A)} \tag{4}$$

Thus, in order to minimize the effect of the active occlusion cancellation circuit on the desired output signal of the receiver 44, the transfer function A of the second filter 48 should match the transfer function R (y/x) from the input of the receiver 44 to the output of the ear canal microphone 28, and |1−AB| should be minimized, e.g. in a desired frequency range, e.g. utilizing least mean squares minimization techniques.

As indicated by the denominator of equations (3) and (4), the circuit 10 of FIG. 2 may become unstable with changes in R, for example outside the ear, which makes insertion of the housing (not shown) with the receiver 44 into the ear canal of the user rather uncomfortable. Also, the first and second filters 36, 48 may have to implement rather long impulse responses requiring many filter taps because the effective implementation is non-recursive, and which is not desirable since both filters operate sample-based at a high rate for low delay.

Figure 3:
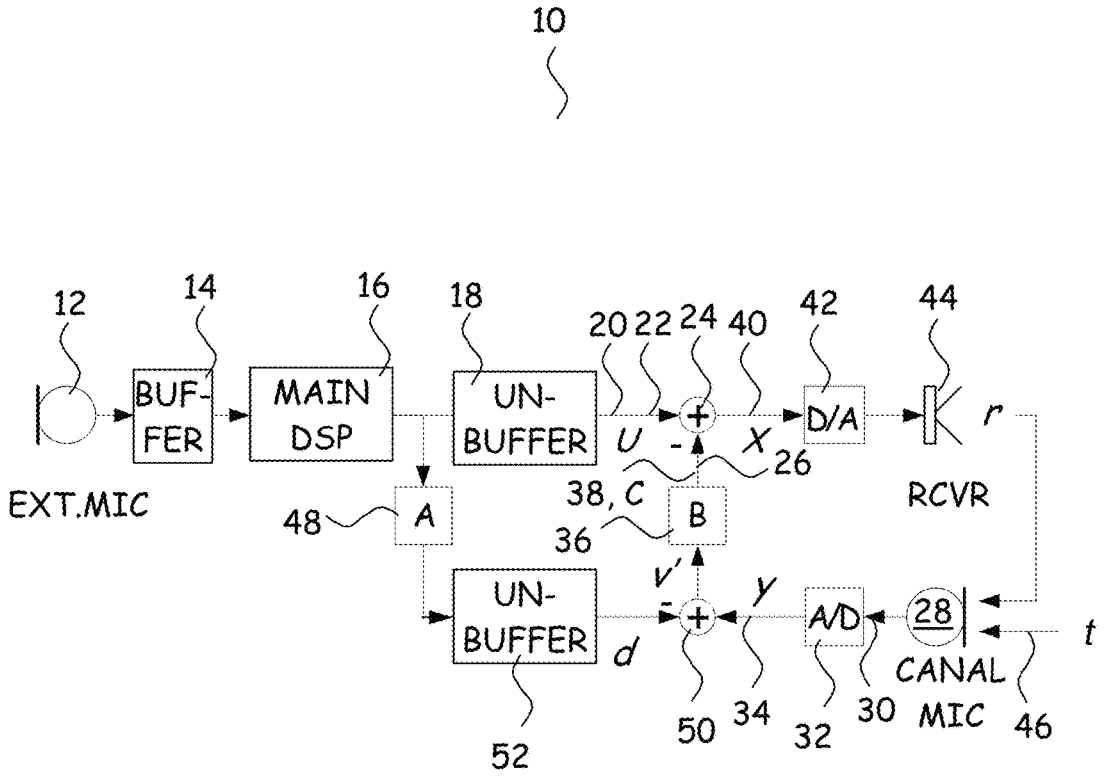
FIG. 3 shows a block diagram of a new active occlusion suppression circuit.

This is avoided in the circuit shown in FIG. 3 showing a block diagram of a circuit of a hearing device falling under the terms of claim 1.

The circuitry 10 of FIG. 3 is identical to the circuitry 10 of FIG. 2 apart from the fact that in the circuitry of FIG. 3 the second filter 48 has been moved outside the active occlusion cancellation loop and a second un-buffer circuit 52 has been introduced. Due to this change, the second filter 48 operates on blocks of samples like the signal processor 16 and, preferably, is included in the signal processor 16 for improved processing efficiency.

In the active occlusion cancellation circuit of FIG. 3, the equations (3) and (4) of the active occlusion cancellation circuit of FIG. 2 turn into:

$$x = \frac{(1 + BA)u - Bt}{1 + BR} \tag{5}$$

$$y = \frac{(1 + BA)Ru + t}{1 + BR} \tag{6}$$

Under optimal conditions BA is equal to BR and the transfer function of the main signal path from the output of the signal processor to the input of the receiver remains identical to the transfer function without active occlusion cancellation so that the dynamic range is not changed and no gain adjustments are needed due to the presence of the active occlusion cancellation.

Figure 4:
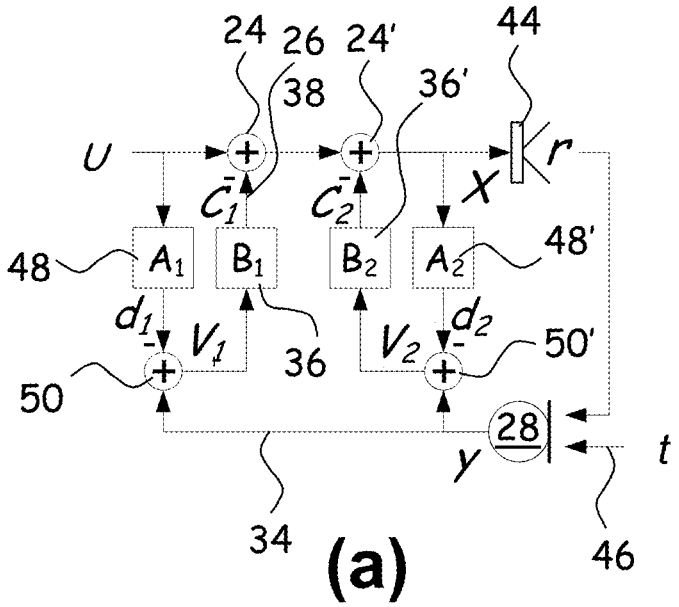
FIG. 4 shows block diagrams of other new active occlusion suppression circuits.
Figure 4:
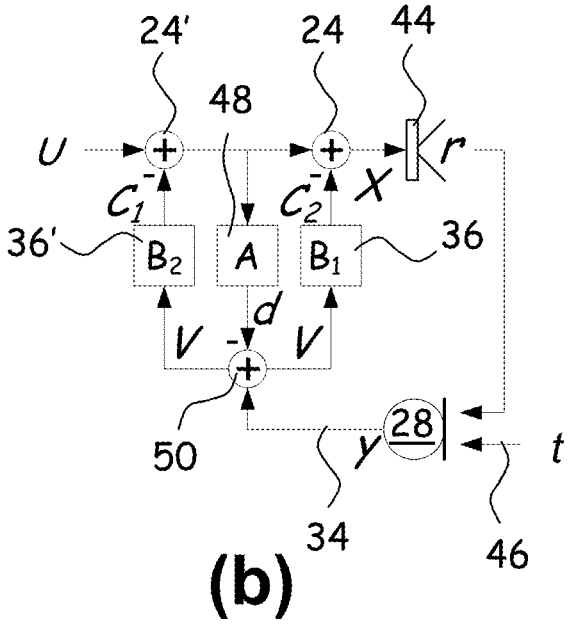

FIGS. 4(*a*) and 4(*b*) shoal combinations of the active occlusion cancellation circuits of FIGS. 2 and 3.

In the active occlusion cancellation circuit of FIG. 4(*a*), the equations (5) and (6) of the active occlusion cancellation circuit of FIG. 3 turn into:

$$x = \frac{(1 + A_1B_1)u - (B_1 + B_2)t}{1 + RB_1 + (R - A_2)B_2} \tag{7}$$

$$y = \frac{(1 + A_1B_1)Ru + (1 - A_2B_2)t}{1 + RB_1 + (R - A_2)B_2} \tag{8}$$

wherein, again, y=Rx+t, and which for $B_1$=0 reduces to equations (3) and (4) relating to the active occlusion cancellation circuit of FIG. 2 and for $B_2$=0 reduces to equations (5) and (6) relating to the active occlusion cancellation circuit of FIG. 3.

In the active occlusion cancellation circuit of FIG. 4(*a*), $v_2$ is a direct estimate of the target signal t whereas $v_1$ includes the effect of active occlusion cancellation on t. Consequently, comparing the two signals could be used to actively monitor the effect of the occlusion cancellation on the users own voice in real time.

If there is no direct need for the individual v1 and v2 signals, it is possible to implement the same response more efficiently by reordering the sections as shown in FIG. 4(*b*) wherein $A_1$=$A_2$=A.

The equivalence of the two forms of FIGS. 4(*a*) and 4(*b*) is similar to how general direct form IIR filters can be implemented by a pole section followed by a zero section as well as the other way around (i.e., first the zeros and then the poles). With respect to the generalized AOC responses, under optimal conditions (i.e. R=A), the $B_1$ filter can be thought of as (recursively) implementing an infinite impulse response (like the poles in a general form IIR filter), while the $B_2$ filter implements a finite impulse response (like the zeros in a general form IIR filter). The ability to tune both the (non-recursive) head and the (recursive) tail of the impulse response independently may provide advantages both in terms of stability and in the number of free parameters required to tune the system as a whole.

The active occlusion cancellation circuits of FIGS. 4(*a*) and 4(*b*) offer more flexibility than the active occlusion cancellation circuits of FIGS. 2 and 3, respectively, at the expense that at least one of the second and fourth filters cannot operate on blocks of samples in the signal processor.

Figure 5:
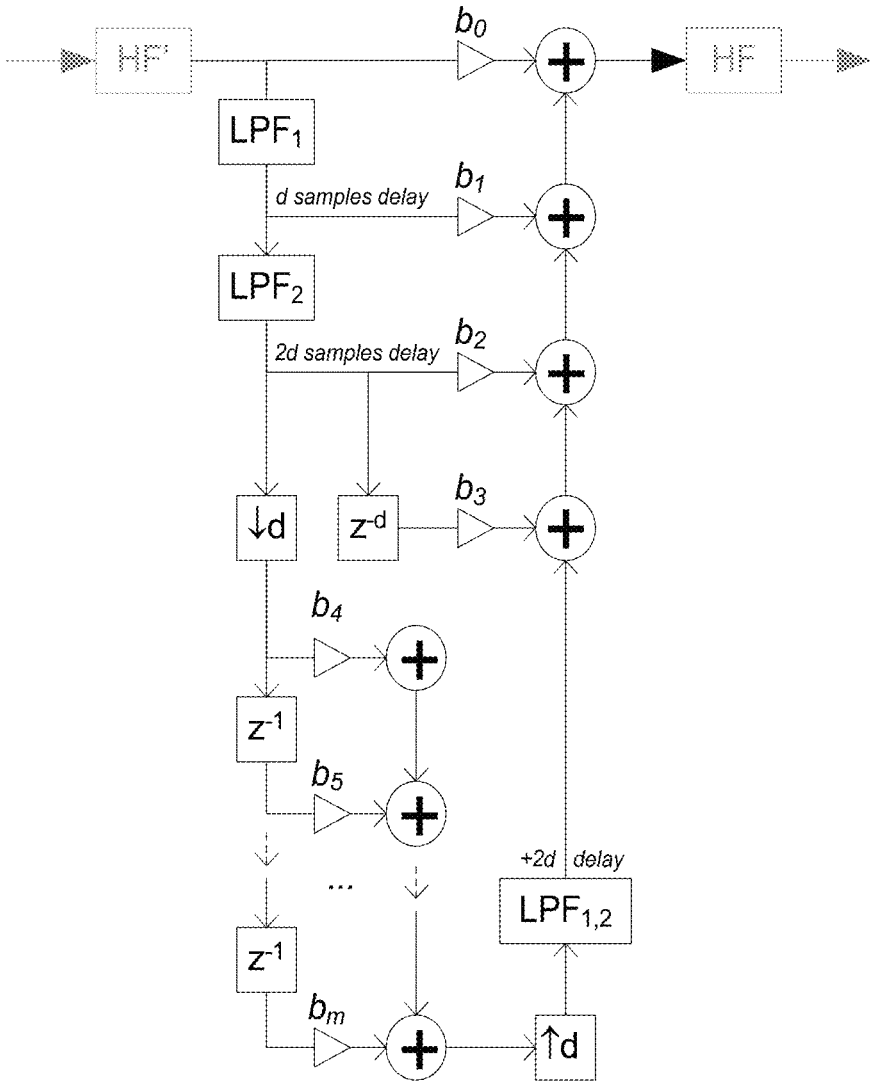
FIG. 5 shows a block diagram of a multi-rate filter.

FIG. 5 shows a block diagram of the first filter 36 that provides the cancellation signal to the first subtractor 24. A multi-rate design is utilized to obtain low delay that is critical for cancellation performance. The leading taps operate at full rate followed by down-sampling, e.g. by 8, to reduce complexity. The low pass filters LPF are moving average filters having low fixed point complexity and result in uniform delay between filter taps as in FIR filters. The group delay between taps is constant (d samples) as a function of frequency as for an ordinary FIR filter. The magnitude responses of leading filter taps, i.e. the taps before down-sampling, are different for high frequencies. The additional filters, e.g. filters with fixed coefficients, HF provide safeguards for leading taps. The additional filters HF', HF can suppress these high frequencies, so that ordinary FIR behaviour can be approximated to an arbitrary degree, possibly at the expense of some increase in group delay.

Figure 6:
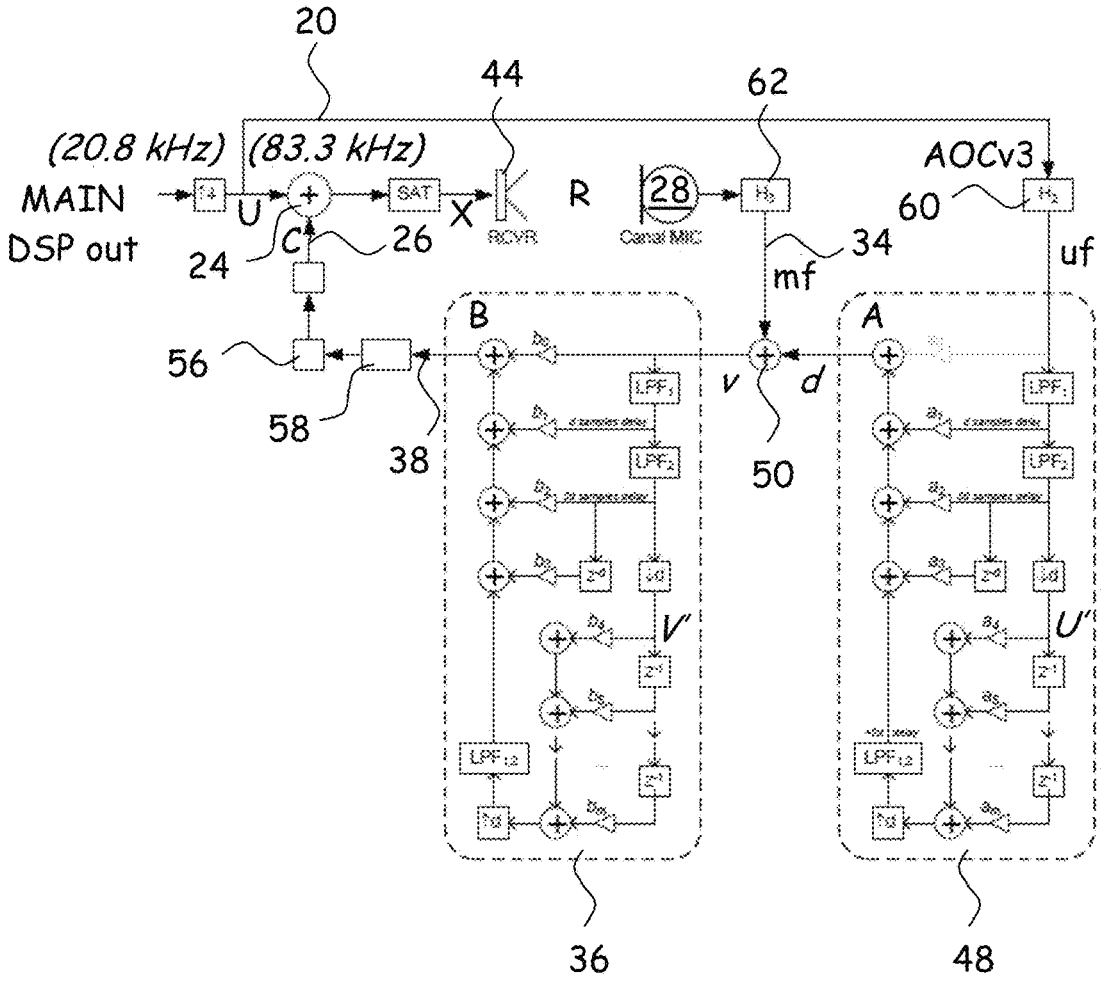
FIG. 6 shows the new active occlusion suppression circuit of FIG. 3 with multi-rate filters of FIG. 5.

FIG. 6 shows a block diagram of the active occlusion cancellation circuit shown in FIG. 3 with two multi-rate FIR filters 36, 48 of the type shown in FIG. 5 and a scalar gain g. The second filter with transfer function A is used to decouple the main DSP output signal from the cancellation loop and identify the response from receiver (out) to canal mic (in). The first filter with transfer function B implements the occlusion cancellation. The scalar gain (g) is used to (quickly) adapt the loop gain in case of potential instability or overload. Filters A and B were designed so that at low frequencies they behave exactly like ordinary FIR filters running at a low sampling rate, but without suffering from resampling delay. The group delay between taps is constant (d samples) over all frequencies, like for on ordinary FIR. However, the leading taps (before down-sampling) do have a different magnitude response for the high frequencies. The additional filters $H_1$, $H_2$, $H_3$ can suppress these high frequencies, so that ordinary FIR behaviour can be approximated to an arbitrary degree (possibly at the expense of some increase in group delay).

When the first and second filters 36, 48 are initialized (explained further below with reference to FIG. 7), the additional filter $H_1$ 58 has two poles, one for low pass filtering and one for DC removal, while the additional filters $H_2$ and $H_3$ are omitted to minimize complexity, due to the fact that the initialization is capable of taking the non-uniform leading tap responses into account.

Without initialization, the responses of additional filters $H_1$, $H_2$, $H_3$ 58, 60, 62 include a one-pole low-pass, a 2-point moving average, and a one-pole DC removal. Adding the two-point moving average elements improves roll-off in the high frequencies, and it is very cost effective because the delay element is shared with the pole section.

To simplify the calculations, all responses may be modelled by linear filters, running at low rate (e.g., baseband/2), and combine the contributions of the 3 additional filters into one block (H) with $H=H_1*H_2$, $H_2==H_3$. The corresponding response from the output provided by the signal processor u and the target signal t to the canal microphone input signal m is given by Equation (9):

$$m = \frac{(1 + HBA)Ru + t}{1 + HBR} \tag{9}$$

Figure 7:
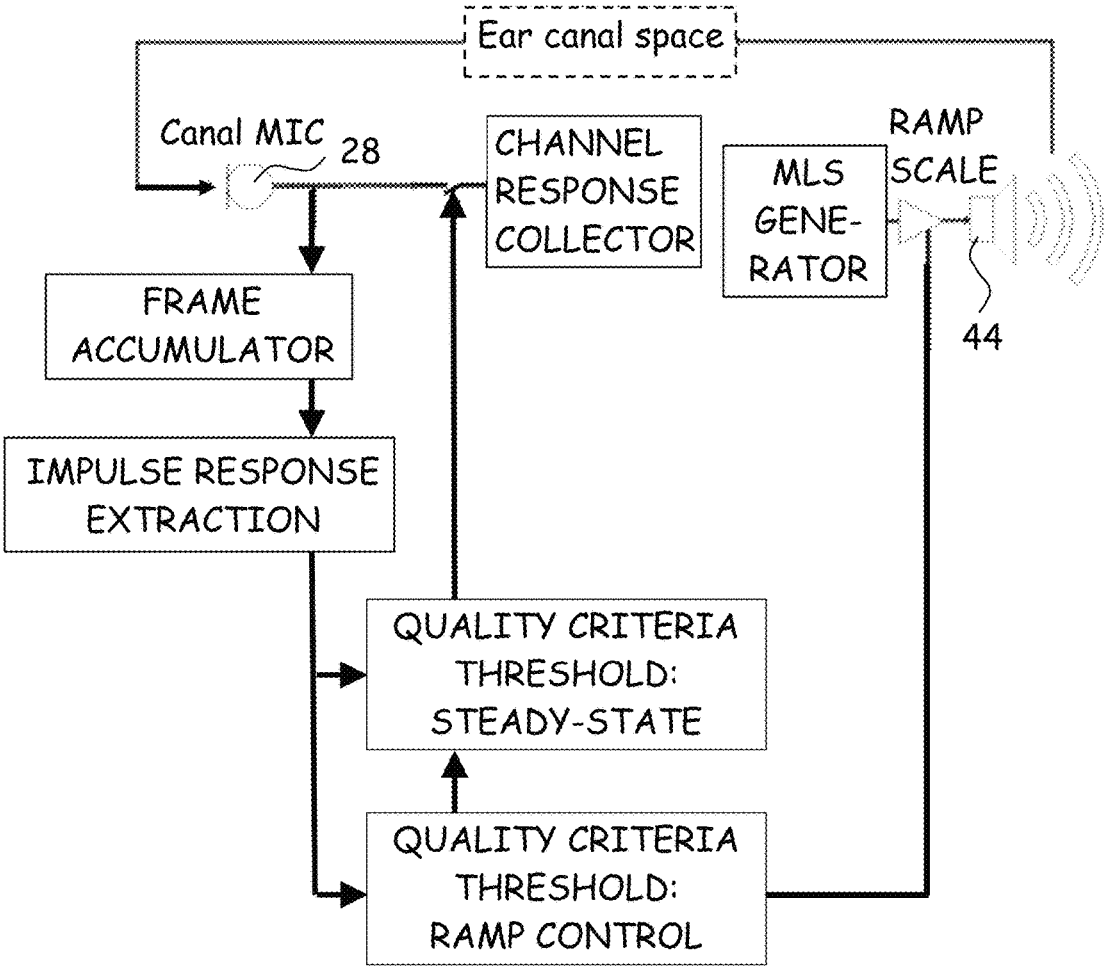
FIG. 7 shows a block diagram of an initialization circuit.

The filters 36, 48 may be initialized, i.e. the filter coefficients of the filters 36, 48 may be determined, during a fitting session during which the hearing device is connected to a PC and the output of the first subtractor 24 is disconnected from the input of the receiver 44 facilitating open-loop determination of the transfer function R of the signal path from the input of the receiver 44 to the output of the ear canal microphone 28 as illustrated in FIG. 7.

As mentioned above, the second filter 48 is intended to model the transfer function R of this signal path, while the first filter 36 calculates the cancellation signal.

As shown in FIG. 7, a probe signal, e.g. a maximum length sequence (MLS) signal, is transmitted to the receiver and based on the ear canal microphone output signal that includes a response the probe signal, the impulse response of the signal path is estimated. The ear canal microphone output signal is transmitted to the PC that performs cross-correlation of the probe signal with the received ear canal microphone output signal to determine the impulse response. Then the PC determines the filter coefficients of the second filter 48 and transfer them to the second filter 48 of the hearing device so that the second filter 48 also has the determined impulse response and so that subsequent to initialization, the second filter 48 models the corresponding signal path.

Subsequent to determination of the filter coefficients of the second filter 48, the PC operates to optimize the transfer function B of the first filter 36 in such a way that BR has a maximum value within a set of constraints including that the hearing device circuit is stable, and including upper limits for peaking and gain, e.g. user adjustable.

The PC may optimize the transfer function B heuristically by an iterative constrained least squares procedure, e.g. including iterative frequency weighting.

Thus, in one example, the PC performs recursive optimization of the following error equation:

$$E(\omega)=w_f(\omega)(T(\omega)-R(\omega)B(\omega)) \tag{10}$$

wherein the weighting function $w_f$ adapts to satisfy constraints and the target function $T(\omega)$ adapts to approach cancellation goals, e.g. the real part of T may be large where cancellation is desired, and the real part of T may be zero where cancellation is not needed, T may be zero where cancellation has to cease.

During the recursive iteration, every iteration step includes a full least squares optimization determining the global minimum of $|E|^2$ for given $w_f$ and T, followed by a step of heuristic update of $w_f$ and T, wherein $w_f$ adapts to satisfy constraints, and T adapts to approach a desired cancellation depth.

The filters 36, 48 shown in FIGS. 3-6 may be adaptive filters that adapt during normal operation of the hearing device.

Figure 8:
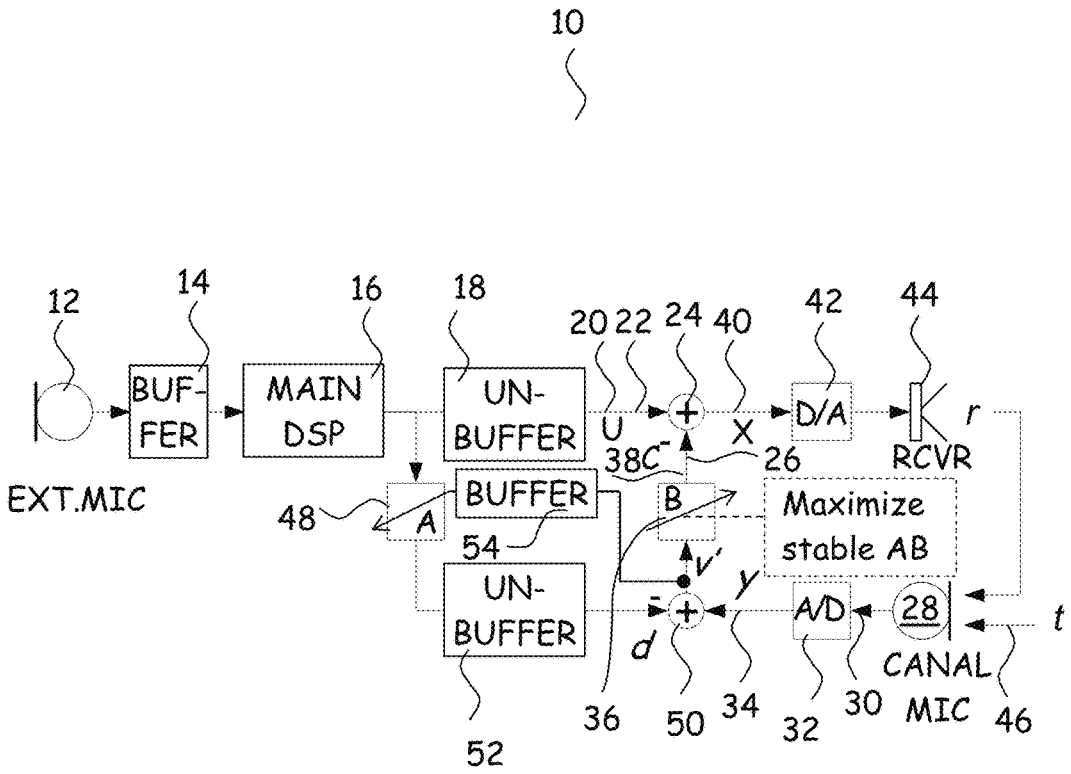
FIG. 8 shows the new active occlusion suppression circuit of FIG. 3 with adaptive filters.

FIG. 8 shows a block diagram of a hearing device circuit 10 with an active occlusion suppression circuit shown in FIG. 3 and in more detail in FIG. 6 and having adaptive filters 36, 48 that adapt during normal operation of the hearing device. The transfer function A of the second filter 48 is adapted toward the transfer function R (equal to y/x) of the signal path from the input of the receiver 44 to the output of the ear canal microphone 28. The first filter 28 is optimized to maximize AB under certain constraints described in more detail below.

The adaptive filters 36, 48 may be initialized, i.e. the filter coefficients of the adaptive filters 36, 48 may be determined during a fitting session during which the hearing device is connected to a PC and the output of the first filter 38 is disconnected from the second input 26 of the first subtractor 24 facilitating open-loop determination of the transfer function R of the signal path from the input of the receiver 44 to the output of the ear canal microphone 28 as illustrated in FIG. 7 and explained above. The initialization may be performed with the algorithms disclosed above with reference to FIG. 7. Alternatively, the optimization of the first filter 36 may be performed during initialization in the same way as explained in the following.

The hearing device circuit 10 of FIG. 8 may be operated without initialization whereby time is saved during a possible fitting session and possible user annoyance due to sound emitted during the MLS measurement is avoided. Also, initialization is impractical for over-the counter sales and performance may degrade over time, e.g. due to slow changes, such as wax build-up, component drift, etc., or due to faster changes, e.g. caused by re-insertion differences. Further, the user's occluded voice spectrum is not taken into account during initialization.

As shown in FIG. 6, the hearing device circuit 10 has two multi-rate FIR filters 36, 48 and a scalar gain 56. The scalar gain 56 is used to adapt the loop gain quickly in case of potential instability or overload. The multi-rate filters 36, 48 are designed so that at low frequencies they operate similar to ordinary FIR filters running at a low sampling rate, but without suffering from resampling delay. The group delay between taps is constant (d samples) for all frequencies as for an ordinary FIR.

However, the leading taps (before down-sampling) do have a different magnitude response for the high frequencies. The additional filters 58, 60, 62 can suppress these high frequencies, so that ordinary FIR behaviour can be approximated to an arbitrary degree (possibly at the expense of some increase in group delay). In the circuit 10 of FIG. 6, each of the additional filters 58, 60, 62 has a low-pass pole, a 2-point moving average, and a one-pole DC removal. The 2-point moving average improves roll-off at high frequencies at low cost since the delay element is shared with the pole section.

To simplify the calculations, all responses may be modelled by linear filters, running at low rate (e.g., baseband/2), and combine the contributions of the 3 additional filters into one block (H) with $H=H_1*H_2$, $H_2==H_3$. The corresponding response from the output provided by the signal processor u and the target signal t to the canal microphone input signal m is given by:

$$m = \frac{(1 + HBA)Ru + t}{1 + HBR} \tag{11}$$

As already mentioned, the transfer function A of the second filter 48 tracks the transfer function R of the signal path from the input of the receiver 44 to the output of the ear canal microphone 28. The transfer function B of the first filter 36 desirably maximizes the denominator (1+HRB) at active occlusion cancellation frequencies without causing undesired side effects such as excessive amplification or instability.

The transfer function A of the second filter 48 may adapt using a normalized least mean squares (NLMS) algorithm adapting the filter coefficients to minimize the difference between the ear canal audio signal and the output of the second filter. The accuracy of the resulting response estimate is dependent on statistical properties of the processed audio signal u and the ear canal audio signal. For example, in an ideal situation t is zero (the user is quiet), and u contains white noise. When this is not the case, e.g., when the user is talking, we may expect reduced accuracy and possibly some bias due to correlations between u and t. A simple way to overcome such issues is to slow down, or temporarily disable, adaptation when t is large. Alternatively some form of filtered cross-correlations known for feedback cancellation systems of hearing aids or other forms of decorrelation could be used.

The first filter 36 adapts based on the transfer function A of the second filter 48 as the best available estimate of the transfer function R. For adequate low frequency behaviour, a good insertion fit in the ear canal is important. A poorly inserted device typically causes a small magnitude response for transfer function A in the low frequencies (because sound pressure leaks away). In a naive implementation this requires transfer function B to become very large, potentially causing overload and instability problems. Therefore when the magnitude response of the first filter 36 is below some threshold, preferably the loop gain is tuned down to zero and the adaption of the second filter 48 is stopped, or the second filter coefficients may be leaked back to zero. Otherwise, the transfer function B of the second filter 48 is adapted to optimize the loop response using a set of constraints and targets, where the targets specify the desired amount of cancellation, and the constraints limit undesired side effects. Constraints are defined for the following aspects:

1. Stability is guaranteed when the complex valued digital frequency response of the denominator (Nyquist contour) does not encircle the origin. In principle, determining Nyquist stability may require a procedure for counting encirclements of the origin (clockwise minus counter-clockwise), which is a bit involved. However, the criterion can be simplified by setting a positive lower limit for the real parts of the complex values because if the contour only uses positive real values it simply cannot encircle the origin.

2. Max peaking sets an upper limit for the expected closed loop gain $1/|1+HAB|$, which is equivalent to setting a lower limit for $|1+HAB|$. The calculations can again be simplified by setting a positive lower limit for the real part of (1+HAB), which means that both the stability and the max peaking constraint can be checked using the same criterion.

3. Max loop gain sets an upper limit for the expected open loop gain $|HAB|$.

4. Max B gain sets an upper limit for the gain $|B|$ of the second filter 48.

When all constraints are satisfied the update considers cancellation performance (so constraints are always satisfied first). It should be noted that normally all constraints can be met simply by lowering the loop gain which may be performed during normal operation of the hearing device using a scalar gain unit as mentioned above, so for reasonable settings there is always a solution that satisfies all constraints. For optimizing the response at cancellation frequencies, large positive real values of the Nyquist contour are generally desirable since they provide cancellation and reduce the risk of instability. Large absolute imaginary values also help, but require a choice between positive and negative direction which may be non-trivial and could increase the risk of getting trapped in a local optimum. In the current implementation, for reaching the cancellation target, the update therefore only uses a real-valued gradient direction. Adding an imaginary part, possibly introduced at a stage where the real valued update has converged, may give some further improvements.

Figure 9:
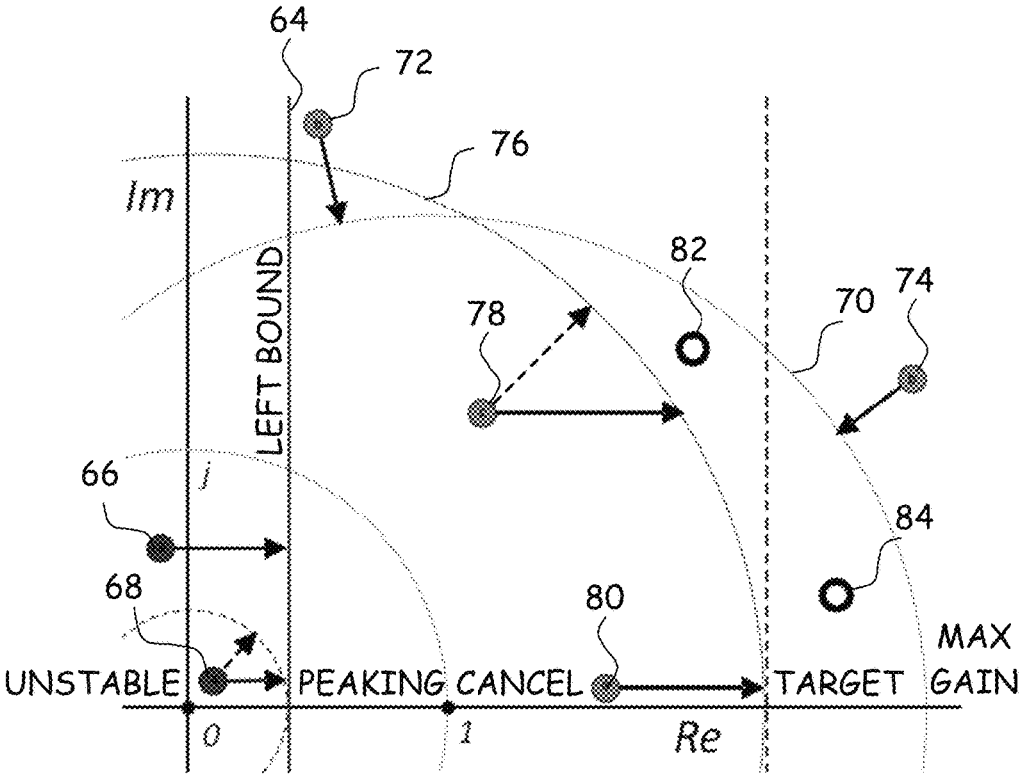
FIG. 9 shows a plot of constraints fulfilled during adaptation.

FIG. 9 provides an illustration of the adaptation procedure with respect to the expected denominator response (1+HAB). Targets and constraints are frequency dependent, but for simplicity a uniform setting is shown. The first two constraints, namely stability and max peaking, are represented by a left bound 64 in the complex plane. If a frequency bin is on the left, such as for the two dots (a) 66, 68, the update points toward the right. The two gain constraints are represented by the circle 70 centred around 1. When the magnitude exceeds this bound, as illustrated by the two dots (b) 72, 74, the update will point back to 1 (equivalent to adapting the transfer function B of the first filter toward zero). The cancellation target is represented by the circle 76 centred around zero. For cancellation frequencies where the denominator response magnitude is below target, such as the two dots (c) 78, 80, the update points toward the right (aiming for larger positive real values). For bins such as the two white dots 82, 84, that provide sufficient cancellation without violating constraints, nothing is done. In principle it would be possible to also specify an upper limit for the amount of cancellation, e.g., to ensure some minimal low-frequency awareness.

The implementation of the transfer function B of the first filter update makes extensive use of the Discrete Fourier Transform (DFT), which can be realized efficiently (O(nlog (n)) using a Fast Fourier Transform (FFT). For a sequence $x_0, x_1, x_2, \ldots, x_{N-1}$ the DFT for frequency bin $X_k$ is given by $$X_k = \sum_{n=0}^{N-1} x_n e^{-2\pi i k n / N} \tag{12}$$

where N is the total number of frequency bins (when N exceeds the sequence length of x, e.g., for a short filter, the missing values can be assumed zero). The Fourier transform is a linear mapping. By representing sequences x and X as vectors the DFT can be written as $$\vec{X} = M\vec{x} \tag{13}$$

where M is a complex valued orthogonal symmetrical matrix, called the Fourier matrix, which performs the mapping from the time domain to the frequency domain. The inverse mapping, back to the time domain, can be done using the same matrix scaled by a factor 1/N.

For a given transfer function B of the first filter with coefficient vector $\vec{b}$, using element-wise ⊙iltiplication ( ) the complex frequency response (Nyquist contour) of the expected AOC denominator response (D) is given by:

$$\begin{aligned} \vec{D} &= 1 + \vec{H} \odot \vec{A} \odot \vec{B} \\ &= 1 + \vec{H} \odot \vec{A} \odot M\vec{b} \\ &= 1 + diag(\vec{H}) diag(\vec{A}) M\vec{b} \end{aligned} \tag{14}$$

Comparing the denominator response $\vec{D}$ to some target $\vec{T}$ provides the error $$\vec{e} = \vec{T} - \vec{D} \tag{15}$$

This can be minimized, in a least squares sense, using a criterion such as $$J = \frac{1}{2}\vec{e}^{*}\vec{e} = \frac{1}{2}\sum_{\forall i} e_i^{*} e_i \tag{16}$$

For which the gradient direction with respect to the filter coefficients of the first filter 36 is given by $$\begin{aligned} \nabla_b &= \left(\frac{\partial J}{\partial b_0}, \frac{\partial J}{\partial b_1}, \ldots\right)' \\ &= -\left(M\left(\vec{e}^{*} \odot \vec{H} \odot \vec{A}\right)\right)^{*} \\ &= -\left(FFT\left(\vec{e}^{*} \odot \vec{H} \odot \vec{A}\right)\right)^{*} \end{aligned} \tag{17}$$

this can be interpreted as reverse-filtering the error through filters with transfer functions H, A, and the Fourier mapping M. Since the filter coefficients are real-valued, the surrounding conjugation (*) is not needed, and M can be implemented efficiently using the Fast Fourier Transform which may be optimized to calculate only the real part of the result. When the error is also real valued, e.g., for stability, peaking & target update, conjugation is not needed for $\vec{e}$ either, so in the simplest form the gradient direction is given by $$\nabla_b = -\text{real}(\text{FFT}(\vec{e} \odot \vec{H} \odot \vec{A}))) \tag{18}$$

Where for stability and max peaking constraints (T=left bound)

$$\vec{e} = \max(0, \text{real}(\vec{T} - \vec{D})) \tag{19}$$

For cancellation (T=cancellation target)

$$\vec{e} = \max(0, \text{real}(\vec{T} - |\vec{D}|)) \tag{20}$$

And for gain constraints (T=0)

$$\vec{e} = -(\vec{H} \odot \vec{A} \odot \vec{B})^{*} \tag{21}$$

Which includes the conjugation of $\vec{e}$ omitted from (18).

Equations 8-11 provide a gradient direction for adapting $\vec{b}$, which might be combined with a simple sign based update using some small fixed step size. Better performance can be obtained by normalizing the gradient, e.g., using a 2-norm, and adding a momentum term, which effectively applies a low-pass filter on the gradient history, reducing the risk of getting trapped in a local optimum. Various further enhancements may be possible to improve the update step, such as adding line searches, adaptive learning rates, conjugate gradients, Hessian estimation techniques, etc.

There are situations where solving a constraint violation using the update of the transfer function B of the first filter alone requires several steps. Instead, an immediate solution can be provided in the form of a broad band gain reduction g. For stability, g could be set to the largest possible value between 0 and 1 for which $$\text{real}(T_i - 1 - gH_iA_iB_i) \le 0 (\forall i) \tag{22}$$

This for real-valued Ti (Ti<1) is solved by $$g = \max\left\{1, \max_{\forall i}\left\{\frac{-\text{real}(H_iA_iB_i)}{1 - T_i}\right\}\right\}^{-1} \tag{23}$$

Using error vector (19) ($e_i$=max (0, real ($T_i$−1−$H_iA_iB_i$))) this can be rewritten as $$g = \left(1 + \max_{\forall i}\left\{\frac{e_i}{1 - T_i}\right\}\right)^{-1} = 1 - \max_{\forall i}\left\{\frac{e_i}{-\mathrm{real}(H_i A_i B_i)}\right\} \quad (24)$$

This may be simplified to $$g = \left(1 + \frac{\max_{\forall i}\{e_i\}}{1 - T_{i_m}}\right)^{-1} = 1 + \frac{\max_{\forall i}\{c_i\}}{\mathrm{real}(H_{i_m} A_{i_m} B_{i_m})} \quad (25)$$

Where $i_m$ is the index where $e_{im}$ is maximal, resulting in a gain reduction that ensures that the largest error is compensated.

Figure 10:
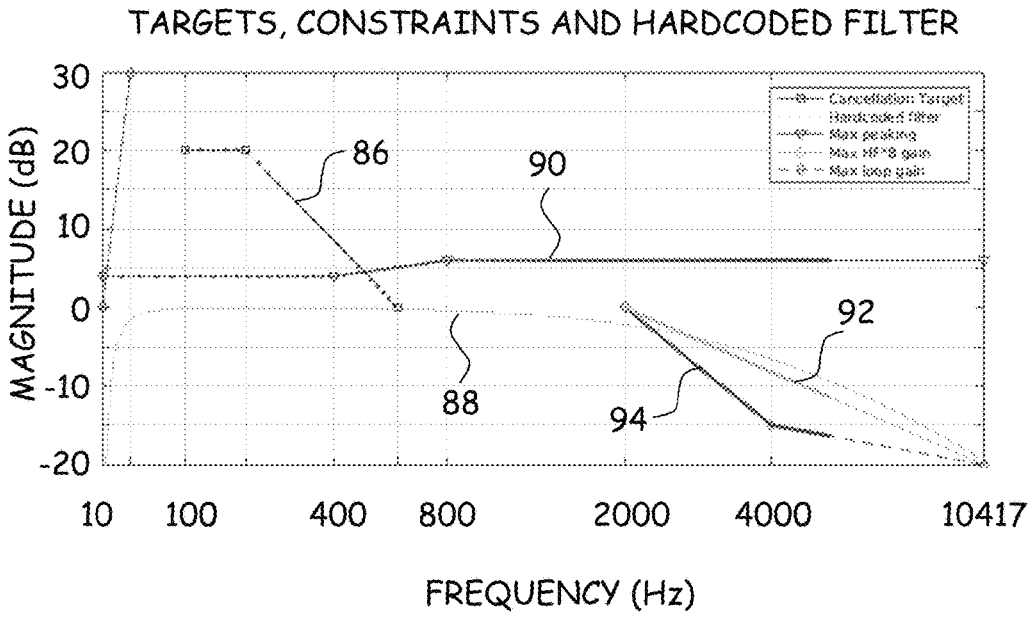
FIG. 10 shows another plot of constraints.

The proposed adaptation algorithm was tested in Matlab on a collection of 102 receiver to canal microphone response paths which were recorded on several different devices and ears, and compared to the results for the active occlusion cancellation circuit of FIG. 3 with initialized first and second filters. Constraints and targets, cancellation target 86; transfer function 88 of the additional filters; max peaking 90; maximum HB gain 92; and maximum loop gain 94; shown in FIG. 10, were set identical for both active occlusion cancellation circuits, except that the new additional filter response was used for the active occlusion cancellation circuit without initialization only. Simulation results were obtained for the following cases:

1. The active occlusion cancellation circuit of FIG. 3 with initialized first and second filters (AOCv3)

2. InitFree AOC wherein the second filter has a fixed transfer function (InitFree(Ω)), using the first filter solution from (11), and adapting the first filter for a number of steps equivalent to 60 seconds at the usual baseband block rate.

3. InitFree AOC wherein the first filter and the second filter are adaptive filters, with a white noise signal forwarded to the receiver. Occlusion responses were sampled after respectively 1, 2, 5, 10 and 20 seconds of adaptation.

Table 1 shows results average over the full dataset. Rows for mean, median and max cancellation represent statistics for the target range (100-600 Hz). Peak gain (the undesired max amplification of the occlusion signal) was of course measured over the full frequency range. Standard deviations (not shown) are generally quite large, mostly in the order of 20 to 40%, which is at least in part due to the variability in the dataset.

TABLE 1

Mean performance results.

| | Initialized | InitFree(Ω) | (1 s) | (2 s) | (5 s) | (10 s) | (20 s) |
|---|---|---|---|---|---|---|---|
| Max cancellation | 14.6 | 10.1 | 11.1 | 10.8 | 10.5 | 10.4 | 10.4 (dB) |
| Mean cancellation | 6.1 | 4.2 | 5.0 | 4.9 | 4.7 | 4.6 | 4.4 (dB) |
| Median cancellation | 5.5 | 3.5 | 3.9 | 4.1 | 3.8 | 3.9 | 3.6 (dB) |
| Peak gain | 5.9 | 4.4 | 4.2 | 4.7 | 4.8 | 4.3 | 4.4 (dB) |

Figure 11:
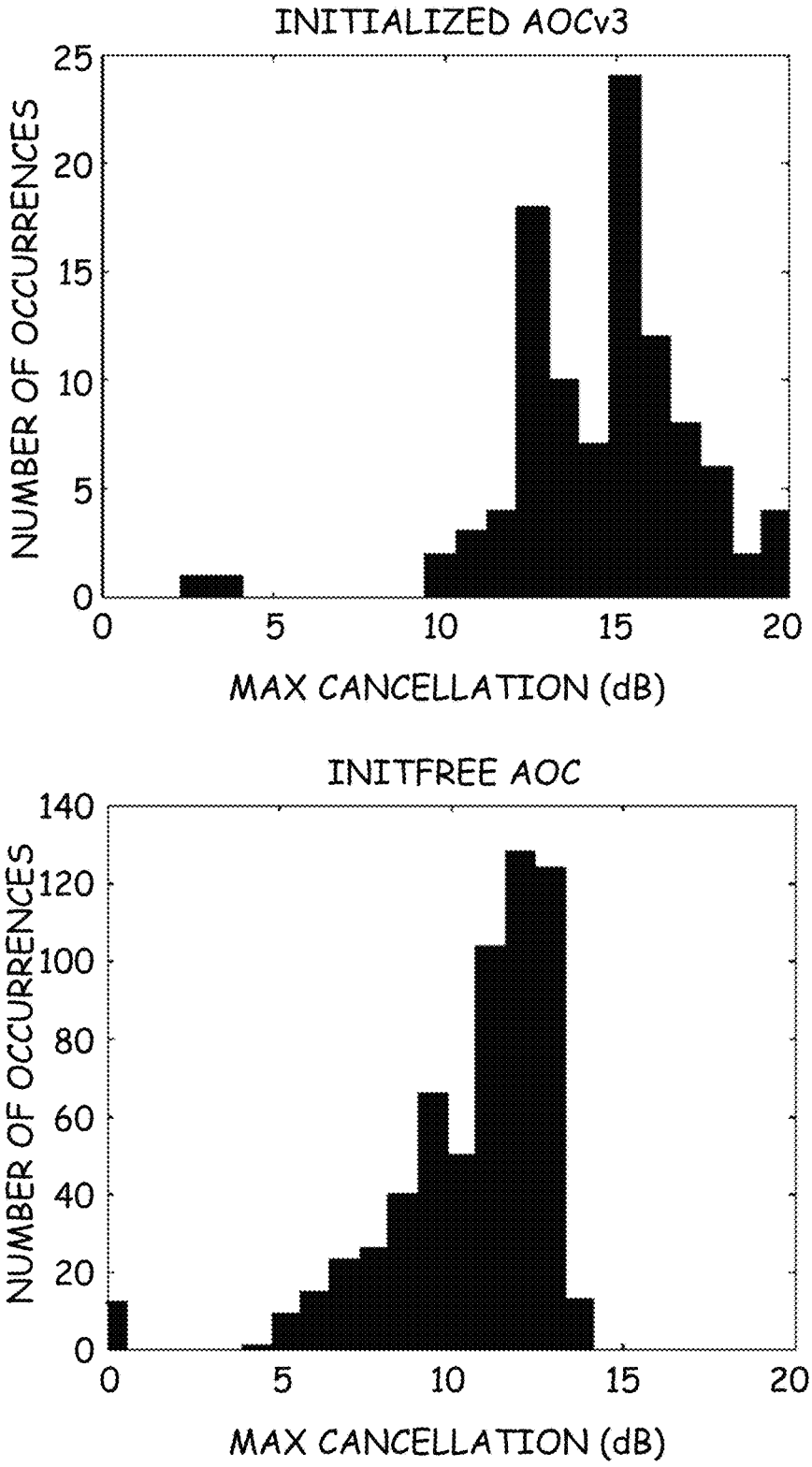
FIG. 11 shows cancellation histograms.

To give an indication of the spread, FIG. 11 shows the distributions of maximum occlusion cancellation results.

The invention claimed is:

1. A hearing device comprising:

a microphone for providing an audio signal in response to ambient sound received at the microphone;

a signal processor configured to process the audio signal in accordance with a signal processing algorithm to generate a processed audio signal;

a first subtractor having a first input configured for reception of the processed audio signal, a second input, and an output for providing a first combined audio signal;

a receiver configured to receive the first combined audio signal, and to convert the first combined audio signal into an output sound signal for emission towards an eardrum of a user of the hearing device;

a housing configured to be positioned in an ear canal of the user, the housing accommodating an ear canal microphone that is configured to provide an ear canal audio signal in response to an ear canal sound pressure, when the housing is positioned in the ear canal;

a second subtractor having a first input configured for reception of the ear canal audio signal, a second input, and an output for providing a second combined audio signal;

a first filter configured to receive the second combined audio signal, and to provide a filtered second combined audio signal to the second input of the first subtractor; and a second filter configured to receive the processed audio signal generated by the signal processor, and to provide a filtered processed audio signal to the second input of the second subtractor.

2. The hearing device according to claim 1, wherein the signal processor is configured for operation in blocks of samples, and wherein the first filter is configured to perform filtering sample by sample.

3. The hearing device according to claim 1 or 2, wherein the second filter is configured to perform filtering in blocks of samples.

4. The hearing device according to claim 1, wherein the second filter is included in the signal processor.

5. The hearing device according to claim 1, further comprising:

a third subtractor coupled between the first subtractor and the receiver, the third subtractor having a first input that configured for reception of the first combined audio signal, a second input, and an output for providing a third combined audio signal; and a fourth subtractor having a first input that is configured for reception of the ear canal audio signal, a second input, and an output for providing a fourth combined audio signal.

6. The hearing device according to claim 5, further comprising a third filter having a transfer function $B_2$, the third filter configured to receive the fourth combined audio signal, and to provide a filtered fourth combined audio signal to the second input of the third subtractor.

7. The hearing device according to claim 6, further comprising a fourth filter having a transfer function $A_2$, the fourth filter configured to receive the third combined audio signal, and to provide a filtered third combined audio signal to the second input of the fourth subtractor.

8. The hearing device according to claim 1, further comprising a third subtractor coupled between the first subtractor and the signal processor, the third subtractor having a first input configured for reception of the processed audio signal, a second input, and an output coupled to the input of the second filter and to the first input of the first subtractor.

9. The hearing device according to claim 8, further comprising a third filter having an input configured for reception of the second combined audio signal, and an output coupled to the second input of the third subtractor.

10. The hearing device according to claim 1, wherein at least one of the first filter and the second filter is a multi-rate filter.

11. The hearing device according to claim 1, further comprising a scalar gain unit configured to adjust a magnitude of the filtered second combined audio signal provided to the second input of the first subtractor.

12. The hearing device according to claim 1, further comprising a signal generator configured for providing a probe signal to the receiver.

13. The hearing device according to claim 12, further comprising a connector for connection of the hearing device to an external device for collection of signals generated in the hearing device in response to the probe signal, wherein the connector is also configured for transmission of signal processing parameters to the hearing device from the external device, the signal processing parameters being based on the collected signals.

14. The hearing device according to claim 1, wherein one or each of the first filter and the second filter is an adaptive filter.

15. The hearing device according to claim 14, wherein one or each of the first filter and the second filter is configured to perform adaptation during normal use of the hearing device.

16. The hearing device according to claim 14 or 15, wherein the second filter has filter coefficients that are variable to reduce a difference between the ear canal audio signal and the output of the second filter.

17. The hearing device according to claim 14 or 15, wherein the first filter has filter coefficients that are adapted towards a target transfer function.

18. The hearing device according to claim 1, wherein the first combined audio signal is equal to the processed audio signal received at the first input of the first subtractor, minus the filtered second combined audio signal received at the second input of the first subtractor.

19. The hearing device according to claim 1, wherein the second combined audio signal is equal to a difference between the ear canal audio signal received at the first input of the second subtractor, and the filtered processed audio signal received at the second input of the second subtractor.

20. The hearing device according to claim 1, wherein the signal processor is a hearing loss processor, wherein the hearing loss processor is coupled upstream with respect to the first subtractor.

21. The hearing device according to claim 1, wherein the processed audio signal is a hearing loss compensated audio signal, and wherein the first input of the first subtractor is configured for reception of the hearing loss compensated audio signal.

* * * * *